United States Patent [19]

Irlam et al.

[11] Patent Number: 4,666,624

[45] Date of Patent: May 19, 1987

[54] DETERGENT BARS

[75] Inventors: Geoffrey Irlam, Merseyside; Michael R. Lowry, Chester; Richard M. Twemlow, Merseyside, all of England

[73] Assignee: Lever Brothers Company, New York, N.Y.

[21] Appl. No.: 797,781

[22] Filed: Nov. 13, 1985

Related U.S. Application Data

[63] Continuation of Ser. No. 623,278, Jun. 22, 1984, abandoned.

[51] Int. Cl.[4] ..... C11D 17/00; C11D 9/10; C11D 15/00

[52] U.S. Cl. ..... 252/134; 252/108; 252/131; 252/DIG. 5; 252/DIG. 16

[58] Field of Search ..... 252/131, 133, 134, 174, 252/174.25, DIG. 5, DIG. 16

[56] References Cited

U.S. PATENT DOCUMENTS

| | | | |
|---|---|---|---|
| 9,152 | 7/1852 | McCord | 252/120 |
| 1,342,783 | 6/1920 | Volz | 252/129 |
| 2,845,391 | 7/1968 | Searle | 252/DIG. 16 |
| 3,941,711 | 3/1976 | Gipson | 252/117 |
| 4,203,857 | 5/1980 | Dugan | 252/91 |
| 4,335,025 | 6/1982 | Barker et al. | 252/500 |

FOREIGN PATENT DOCUMENTS

| | | |
|---|---|---|
| 0339047 | 8/1915 | Fed. Rep. of Germany . |
| 0649731 | 7/1927 | France . |
| 0888784 | 12/1943 | France . |
| 0397127 | 2/1966 | Switzerland . |

OTHER PUBLICATIONS

Martin Geoffrey, "The Modern Soap and Detergent Industry", vol. II, Sec. VII, pp. 6–11, Technical Press, London (1951).

"Veegum", R. T. Vanderbilt Co., N.Y. (1964), p. 3.

Vanderbilt Report, R. T. Vanderbilt Co., Jun. 1968.

*Primary Examiner*—Paul Lieberman

*Assistant Examiner*—John F. McNally

*Attorney, Agent, or Firm*—Milton L. Honig; James J. Farrell

[57] ABSTRACT

The presence of iron in a detergent bar originating from sheet aluminosilicates, e.g. kaolins, may lead to color and odor degradation. However sheet alumino-silicates containing a relatively high amount of total iron are suitable for inclusion provided their free iron content is not more than 50 ppm.

3 Claims, No Drawings

DETERGENT BARS

This is a continuation of Ser. No. 623,278, filed June 22, 1984, now abandoned.

BACKGROUND OF THE INVENTION

Soap bars containing sheet alumino-silicates, for example kaolins, have been described in the literature. The presence of iron in a detergent bar will lead to color and odor degradation. Sheet alumino-silicates having a relatively high iron content are usable in bars provided the amount of free iron in the sheet alumino-silicate is low.

FIELD OF THE INVENTION

The invention is applicable to soap bars suitable for personal washing and fabric cleaning in which soaps, that is water soluble salts of long chain ($C_8$ to $C_{20}$) mono-carboxylic acids form the major proportion, ie above about 40% by weight, of the bar. Non-soap detergent actives suitable for use in detergent bars may also be present. Examples of these detergents are alkyl benzene sulphonates, acyl isethionates, alcohol sulphates, ethoxylated alcohols, alkane sulphonates and alkene sulphonates.

GENERAL DESCRIPTION OF THE INVENTION

Sheet alumino-silicates, for example kaolins, containing above 0.2% of iron would be seen generally as unsuitable for inclusion in a detergent bars. However iron can exist in sheet alumino-silicates in two general environments as a 'bound' form which is intimately associated with the lattice and a 'free' form which is associated with the alumino-silicate lattice by means of weaker bonds. A clay (sheet alumino-silicate) with a free iron content of not more than 50 ppm (when measured by a test method to be described more fully hereafter) has been found to be usable in a soap based detergent bar even when the latter contains free fatty acid. The presence of this latter component usually increases the discoloration and odor degradation found with high concentrations of iron. A usual level of free fatty acid is at least 1% by weight of the bar.

The sheet alumino-silicate, i.e. kaolin, component will usually be present in the bar at a level at least about 5% by weight and may form up to about 50% of the bar.

It is preferable for the sheet alumino-silicate to be present in an amount below that which would provide a level of 10 ppm free iron in the bar. Levels of free iron above this level may not be fully sequestered by the usual commercial stabilizer systems. Kaolin is the preferred sheet alumino-silicate.

The present invention allows the incorporation of clays (sheet alumino-silicate) which would be dismissed from consideration as a component because of their high iron content provided the clay sample is tested to determine the free iron content.

TEST METHODS

The total iron concentration is measured using a method destructive of the alumino-silicate structure while free iron is measured by a leaching step.

(i) Total iron: Approximately 0.1 g of the clay sample is accurately weighed into a platinum crucible. 0.5 g of lithium metaborate (AR) is added, and the mixture is fused in a furnace at 1000° C. for 20 minutes.

After this period the sample is allowed to cool and is then dissolved by stirring with a solution consisting of 4% nitric and 2% tartaric acids. When the melt was completely dissolved, the solution is made up to a known standard volume (50 mls) at 20° C. with the nitric/tartaric acid mixture.

This solution is then analysed for iron by an appropriate method eg atomic absorption spectroscopy.

(ii) Free iron: Approximately 2.5 g of kaolin is accurately weighed, and added to 15 mls of 0.05 molar hydrochloric acid. The mixture is heated to boiling for a fixed length of time (1 minute). The extraction is stopped after this time by immediate dilution with cold distilled water (at 6° C.), to a standard volume (100 mls) at 20° C., and subsequent removal of the clay by centrifugation. A sample of the supernatant liquor is then removed and analysed for iron by an appropriate method eg, atomic absorption spectroscopy.

EXAMPLES

A soap base derived from a feedstock of tallow (58%) and coconut oil (42%) was prepared using normal processing; 5.75% free coconut fatty acids were added. The base contained normal amounts of opacifier, perfume and stabiliser. Kaolin (10% by weight) was included in the test bars at the milling sttep; three samples of test soap bars were prepared, each containing a specified sample of kaolin.

Test and control soap bars, the latter not containing clay, were stored for 6 weeks at 45° C. (accelerated storage). They were then tested for colour deterioration (ΔE) against the control by taking measurements in a uniform colour space.

The results are given in the Table:

TABLE

| Sample | Total Iron (%) | Free Iron (ppm) | ΔE |
|---|---|---|---|
| A | 0.26 | 33.9 | 9.0 |
| B | 1.20 | 41.9 | 12.5 |
| C | 0.42 | 88.6 | 22.3 |

The samples A and B are found to provide acceptable degradation for commercial use. Sample C gave a higher colour degradation than Sample B though the latter had a higher level of total iron.

What we claim is:

1. A detergent bar containing at least 40% by weight of water-soluble salts of long-chain fatty acids and an amount from about 5% up to about 50% by weight of the bar of a sheet alumino-silicate component, wherein the sheet alumino-silicate is kaolin and contains above 0.2% by weight of iron total but not more than 50 ppm of free iron.

2. A detergent bar according to claim 1 containing at least 1% of free fatty acid.

3. A detergent bar according to claim 1 wherein the sheet alumino-silicate component is present in an amount below that which would provide a level of about 10 ppm free iron in the bar.

* * * * *